US005281514A

United States Patent [19]

Desie et al.

[11] Patent Number: 5,281,514

[45] Date of Patent: Jan. 25, 1994

[54] DIMENSIONALLY STABLE PHOTOGRAPHIC ELEMENT

[75] Inventors: Guido Desie, Herent; Eric Verschueren, Merksplas, both of Belgium

[73] Assignee: AGFA-Gevaert, N.V., Mortsel, Belgium

[21] Appl. No.: 988,909

[22] Filed: Dec. 10, 1992

[30] Foreign Application Priority Data

Dec. 24, 1991 [EP] European Pat. Off. ..... 91203404.8

[51] Int. Cl.[5] ..... G03C 1/76

[52] U.S. Cl. ..... 430/533; 430/523; 428/430

[58] Field of Search ..... 430/523, 533, 531, 496; 428/228, 241, 325, 384, 406, 430

[56] References Cited

U.S. PATENT DOCUMENTS

| | | | |
|---|---|---|---|
| 3,864,132 | 2/1975 | Rasch et al. | 430/496 |
| 4,318,970 | 3/1982 | Kurlantz et al. | 430/533 |
| 4,329,409 | 5/1982 | Wreede et al. | 430/533 |
| 4,891,298 | 1/1990 | Tsukukiri et al. | 430/523 |

*Primary Examiner*—Jack P. Brammer

*Attorney, Agent, or Firm*—Breiner & Breiner

[57] ABSTRACT

Photographic element having high dimensional stability comprising a hydrophobic polyester film support, a barrier layer retarding diffusion of water in liquid or vapor phase into the hydrophobic polyester film support, and at least one hydrophilic image-precursor layer, said barrier layer being a vapor-deposited glass layer.

6 Claims, 2 Drawing Sheets

DIMENSIONALLY STABLE PHOTOGRAPHIC ELEMENT

FIELD OF THE INVENTION

The present invention relates to a photographic element having high dimensional stability, said element comprising a hydrophobic polyester film support, a barrier layer retarding diffusion of water in liquid or vapour phase into said hydrophobic polyester film support, and at least one hydrophilic image-precursor layer.

BACKGROUND OF THE INVENTION

By the expression "hydrophilic image-precursor layer" as used herein a hydrophilic layer is meant that can be a photosensitive silver halide hydrophilic layer or a hydrophilic layer in which an image can be formed e.g. by receiving an image from a donor element such as by the silver salt diffusion transfer reversal method (DTR-method).

In several photographic fields e.g. microphotography, astrophotography, aerophotography, photogrammetry, holography, recording of nucleophysical phenomena, the preparation of masks for use in the production of microelectronic integrated circuits or printed circuit boards (PCB), the preparation of lithographic offset printing forms e.g. according to the DTR-method, the dimensional stability of the photographic material used for making the desired record is of utmost importance, and this applies to such photographic material both in unprocessed and processed state.

Photographic materials comprise at least one hydrophilic layer coated on a support. Polymer film supports such as cellulose acetate and polyester supports have the disadvantage of absorbing water both in vapour and in liquid form. Owing to the absorption of water vapour from the atmosphere or of fluid water from processing liquids e.g. developing baths the dimensions of polymer film supports start changing. The hydrophilic layer(s) tightly adhering to the polymer film supports have to follow these dimensional changes and undergo internal stresses. As a consequence, the dimensions of the recorded image data may differ inacceptably from those of the recorded subject.

In the past, glass plates have been used customarily when photographic supports having a high dimensional stability were needed, especially in the photographic fields specified above. Glass does not absorb water vapour or fluid water and has, therefore, found extensive use as a transparent dimensionally stable support in these photographic fields. Nevertheless, glass has the disadvantage of being heavy, voluminous, and fragile. Moreover, the coating of photographic hydrophilic layers on glass plates and the sizing of the coated material poses great problems, especially when continuous coating and sizing are desired.

Attempts have therefore been made in recent years to enhance the dimensional stability of polyester film supports for photographic use by inhibiting or at least retarding absorption of water vapour or fluid water by these supports.

It is known for instance from U.S. Pat. No. 4,933,267 to coat a polyester film support for a silver halide photographic material, at least one side of said support having a polymer latex, on both sides with a polymer layer comprising a copolymer containing fom 50 to 99.5% by weight of vinylidene chloride, both polymer layers having a thickness of at least 0.3 μm.

In EP-A 343,642 a silver halide photographic material has been described, which is composed of a polyester film support having thereon at least one hydrophilic colloid layer containing a polymer latex and between the support and the hydrophilic colloid layer a layer containing a vinylidene chloride copolymer core-shell latex, at least one hydrophilic colloid layer being a light-sensitive silver halide emulsion layer.

However, polyester film supports coated with vinylidene chloride copolymer layers have the disadvantage of providing insufficient tightness to water and water vapour. Moreover, the use of chlorine-containing compounds such as vinylidene chloride copolymers raises ever growing environmental objections since combustion of waste material comprising such chlorine-containing copolymers may lead to the production of toxic chlorine gas, which itself in the presence of organic compounds may form other toxic substances such as dioxine.

In U.S. Pat. No. 3,864,132 a photographic material has been described, which is composed of a hydrophobic polymer supporting surface, a subbing layer, and a hydrophilic colloid layer, wherein said subbing layer essentially consists of an inorganic oxide sush as silicon monoxide or silicon dioxide.

Unfortunately, a silicon monoxide or silicon dioxide layer is far too permeable to water liquid or vapour and thus has no satisfactory barrier function.

In GB-A 2,074,345 a pre-holographic element has been described, which is composed of an optically transparent hydrophobic support, a layer of a glassy, optically transparent, polar, moisture barrier material formed at a temperature that should not deform said support, and a hydrophilic photosensitive material. The glassy layer is a silicon dioxide layer deposited by electron beam and having a high thickness of 0.2 to 10 μm.

Such thick glassy layers may lead to inhomogeneity of the glassy material; cracks may indeed appear. Furthermore, the transparency of thicker layers is reduced. These disadvantages are frequently encountered in the case of special processing conditions such as high temperature development.

SUMMARY OF THE INVENTION

It is an object of the present invention to provide a photographic element having high dimensional stability, said element comprising a hydrophobic polyester film support, a barrier layer retarding diffusion of water in liquid or vapour phase into said hydrophobic polyester film support, and at least one hydrophilic image-precursor layer.

Further objects of the present invention will become clear from the description hereinafter.

According to the present invention a photographic element having high dimensional stability is provided, said element comprising a hydrophobic polyester film support, a barrier layer retarding diffusion of water in liquid or vapour phase into said hydrophobic polyester film support, and at least one hydrophilic image-precursor layer, wherein said barrier layer is a glass layer, preferably a vapour-deposited glass layer having a thickness of at least 0.01 μm and substantially composed of $SiO_x$, x standing for a value ranging from 1.2 to 1.8.

DETAILED DESCRIPTION OF THE INVENTION

Figure 1:
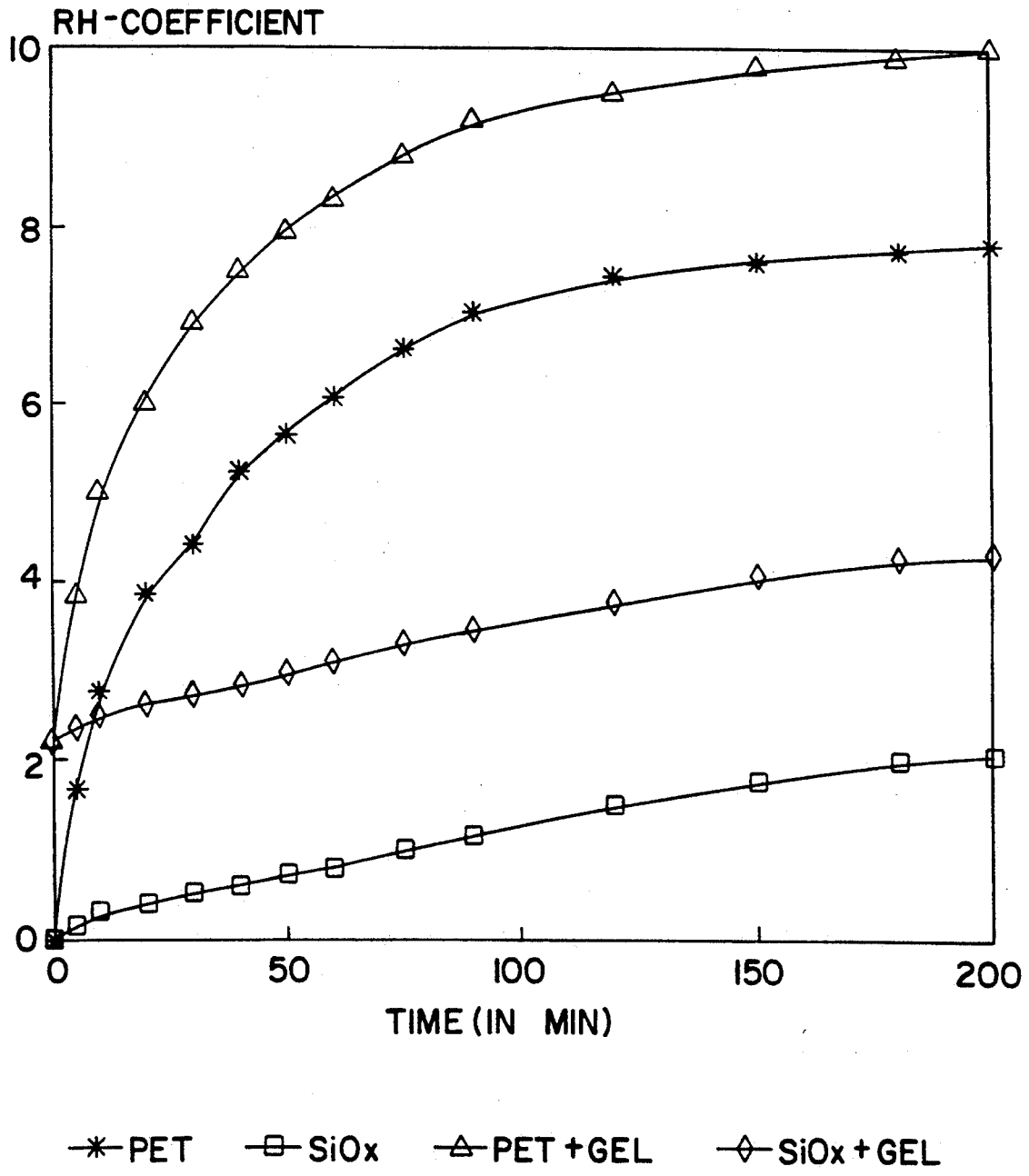

The glass layer, preferably a $SiO_x$ layer, can be vapour-deposited according to the processes described in i.a. UK Patent Application No. 2,211,516 and the paper "Transparent Barriers for Foodpacking" presented by T. Krug and K. Rübsam (LEYBOLD AG, Hanau, Federal Republic of Germany) on SVC-Conference New Orleans, Apr. 29 to May 4. 1990.

The $SiO_x$ can be vapour-deposited e.g. by thermal evaporation, electron beam gun evaporation, or sputtering of Si or of SiO (silicon monoxide) wherein x is 1 ( x has a value of 2 in $SiO_2$). The evaporation temperature is about 1350° C. The vapour of SiO is oxidized in a controlled reactive atmosphere to achieve at the vapour-deposited glass layer a degree of oxidation ranging from 1.2 to 1.8. In other words, x stands for a value ranging from 1.2 to 1.8, preferably 1.5 to 1.7.

Physically the vapour-deposited $SiO_x$ layer consists of a mixture of SiO, $Si_2O_3$, and $SiO_2$. The $SiO_x$ layer is chemically inert and protects the polyester film support from absorbing water vapour from the atmosphere or other water vapour sources. Moreover, it substantially protects the polyester film support from absorbing water from processing liquids such as i.a. developing baths, fixing baths, bleaching baths, and rinsing water. Although the non-absorption or retarded absorption of water or water vapour is not a prime object of the barrier layer, it has the useful consequence that the object of the present invention i.e. an enhanced dimensional stability is achieved.

The thickness of the vapour-deposited $SiO_x$ layer should not be lower than 0.01 μm, since otherwise insufficient improvement of the dimensional stability is achieved. In general, the vapour deposited $SiO_x$ layer has a thickness ranging from 0.01 to 0.20 μm, preferably from 0.05 to 0.15 μm. Thickness values above 0.20 μm do not result in further improvement of the dimensional stability.

One side or both sides of the polyester film support can be provided with a vapour-deposited $SiO_x$ layer and in case the polyester film support is provided according to a preferred embodiment on both sides with a vapour-deposited $SiO_x$ layer, the $SiO_x$ layers need not have the same thickness.

Notwithstanding the fact that a vapour-deposited $SiO_x$ layer as above described can improve the dimensional stability of many types of polymer film supports for photographic use and can consequently be applied thereto, it is especially interesting for being used on polyester film supports. Thanks to their favourable mechanical properties polyester film supports find extensive use indeed in various types of photographic elements.

Polyester film supports that can be covered advantageously with a vapour-deposited $SiO_x$ layer in accordance with the present invention are films of polyesters of alkylene glycol and/or glycerol with terephthalic, isophthalic, adipic, maleic, fumaric and/or azelaic acid. Polyethylene terephthalate is the most preferred polyester film support for use according to the present invention. Polyethylene terephthalate film supports for photographic use currently have a thickness ranging from about 100 to about 250 μm.

It is also possible to laminate a thin polyester film carrying a vapour-deposited $SiO_x$ layer on at least one side of a polyester film support for photographic use e.g. by bonding the thin film to the photographic support.

Although preferably a photosensitive silver halide emulsion layer is used as hydrophilic image-precursor layer in accordance with the present invention because of its excellent photographic characteristics, other photosensitive substances can be applied as well to the vapour-deposited $SiO_x$ layer of a polyester film support.

Photosensitive silver halide emulsions that are suited for use in photographic elements of the present invention can be chosen from those currently used in the photographic fields enumerated in the preamble hereinbefore, in other words whenever the dimensional stability of the photographic material is of utmost importance in unprocessed as well as processed state.

Instead of the preferred photosensitive silver halide emulsions other photosensitive substances can be applied to the vapour-deposited $SiO_x$ layer of a polyester film support. Among these are e.g. silver salts other than silver halide, zinc oxide, diazonium salts, and photopolymers.

The photographic element of the present invention may in addition to at least one hydrophilic image-precursor layer comprise one or more additional non-photosensitive hydrophilic layers that stand in water-permeable relationship with said hydrophilic image-precursor layer(s).

The hydrophilic image-precursor layer of the photographic element of the present invention may - instead of being a photosensitive silver halide hydrophilic layer - be a non-photosensitive hydrophilic layer that is adapted for receiving an image from a donor element such as by the DTR-method. In the latter case said non-photosensitive hydrophilic layer is a silver-receptive stratum containing physical development nuclei for precipitation of silver in said stratum from water-soluble silver complexes diffusing from an exposed silver halide donor element. The principles of the DTR-process have been described in e.g. U.S. Pat. 2,352,014 and more detailedly in "Photographic Silver Halide Diffusion Processes" by AndréRott and Edith Weyde - The Focal Press - London and New York, (1972).

It may be advantageous to improve the adhesion of hydrophilic layers, usually hydrophilic colloid layers, to the vapour-deposited $SiO_x$ layer as described in U.S. Pat. 3,661,584 viz. by coating the hydrophilic colloid layer composition on the $SiO_x$ layer in the presence of a silane compound i.e. an organic silicon compound comprising hydrocarbon groups directly or indirectly attached to a silicon atom, at least one of said hydrocarbon groups carrying a group or atom that has chemical affinity for the free reactive groups of said hydrophilic colloid or that can be cross-linked to said free reactive groups through the intermediary of a cross-linking agent.

The present invention is illustrated by the following examples without limiting it thereto.

EXAMPLE I

The ever exacting requirements for a higher definition in photographic records and for the capability of photographic elements of recording smaller line widths as is desired for in stance in the production of multilayer printed circuit boards (PCB), imposes stricting demands on the quality of the photographic elements used as well as on the conditioned rooms in which the manufacture of these elements takes place.

The easiest way to comply with these exacting requirements is to improve the dimensional stability of the photographic elements used.

The now commercially available photographic elements have a RH-coefficient (i.e. a coefficient representing the dimensional change as a consequence of a change in relative humidity) of approximately 11 μm/m/%RH, wherein %RH stands for percent of relative humidity. This value can be subdivided into 8 μm/m/%RH, which is due to the polyester film support and 3 μm/m/%RH due to the hydrophilic layers.

After processing of the photographic elements typical dimensional deviations reach an order of magnitude of 20 to 40 μm/m/processing.

From these data it is obvious that a reduction of the RH-coefficient of the polyester film support would have the greatest benefit.

Notwithstanding tolerances as low as approximately 5%RH in optimally conditioned rooms it has been established these days that a dimensional change of $10\times8=80$ μm/m is rather unavoidable. Under conventional working conditions including breathing on the film etc. even more important deviations can be encountered.

The best way to improve the film support would be to replace the polyester by another "better" polymer. However, a polymer that is better than polyester and in particular than polyethylene terephthalate (PET) for use in various applications has not been discovered so far.

A more convenient solution to the problem would be to cover the PET film support with a thin barrier layer so that the dimensional change of the support would be ruled by the reduced speed of vapour penetration through the barrier layer. This would only help, of course, if the reduction of the speed of dimensional change is slow enough compared with the normal working habits.

The control of a conditioned room typically is performed on a minute time scale so that fluctuations in relative humidity would conveniently be levelled off with the aid of a "1-hour delay" barrier layer on the PET film support. As soon as the outdoor conditions would change (e.g. sunshine after rain), the change of relative humidity indoors should be levelled off during the time needed for completing a typical PCB production. On the assumption that a typical PCB production can be finished in about 4 h, the dimensional change ought to be reduced by at least 100% during that period of time as compared with classical photographic applications. From this point of view it is clear that the dimensional change measured after 4 to 5 h should be better by a factor of at least 100% as compared with that measured on conventional PET film support.

The inventors, having in mind that glass supports used for photographic purposes have a high dimensional stability, made tests to check whether conventional PET film supports for photographic use, which have a thickness of at least 100 μm, could be provided with a glass layer that would form a barrier against water in vapour and in liquid form and possibly give an increased dimensional stability to the PET film supports.

For that purpose commercially available transparent food-packing TOYO GT film (obtainable from Toyo Ink Manufacturing Co Ltd, Japan) consisting of 12 μm thick polyethylene terephthalate film carrying a vapour-deposited $Sio_x$ ($x=1.7$) layer having a thickness of 0.06 μm was bonded onto a conventional PET film support for photographic use having a thickness of 100 μm. The resulting laminate comprising a glass barrier layer would behave with respect to the reduction in kinetics of adaptation to relative humidity changes in substantially the same way as a PET film support for photographic use, on which a $SiO_x$ layer would have been vapour-deposited directly.

In a first test the following samples were compared with respect to said reduction in kinetics of adaptation to relative humidity changes.

Sample A

A conventional photographic PET film support having a thickness of approximately 120 μm and carrying subbing layers as described in example 3 of U.S. Pat. No. 3,649,336, but carrying no glass layer(s)

Sample B

A subbed conventional photographic PET film support as described for Sample A and coated with a common photosensitive silver halide gelatin layer having a dry weight of 4 g/m2

Sample C

A conventional photographic PET film support having a thickness of approximately 100 μm was covered on both sides with a glass layer by bonding an above-mentioned commercially available transparent food-packing TOYO GT film consisting of PET (12 μm thick) carrying a vapour-deposited $SiO_x$ ($x=1.7$) layer (0.06 μm thick) by means of epoxy adhesive, the glass layers being the outermost layers.

Sample D

Same as Sample C but carrying on one of the vapour-deposited $SiO_x$ layers a common photosensitive silver halide gelatin layer coating comprising 6% by weight of the epoxysilane compound No 4 described in column 2 of U.S. Pat. No. 3,661,584, the photosensitive layer coating having a dry weight of 4 g/m2.

The absorption kinetics after change of the relative humidity of the the above Samples A to D are represented in FIG. 1; the results obtained for Sample A are represented by the "PET" curve showing asterisks, those obtained for Sample B by the "PET+gel." curve showing small triangles, those obtained for Sample C by the "$SiO_x$" curve showing squares, and those obtained for Sample D by the "$SiO_x$+gel." dashed curve.

It can be derived from the results represented in FIG. 1 that the improvement obtained with Samples C an D as against Samples A and B respectively at a time scale of about 180 min is of the order of magnitude of 150%.

Figure 2:
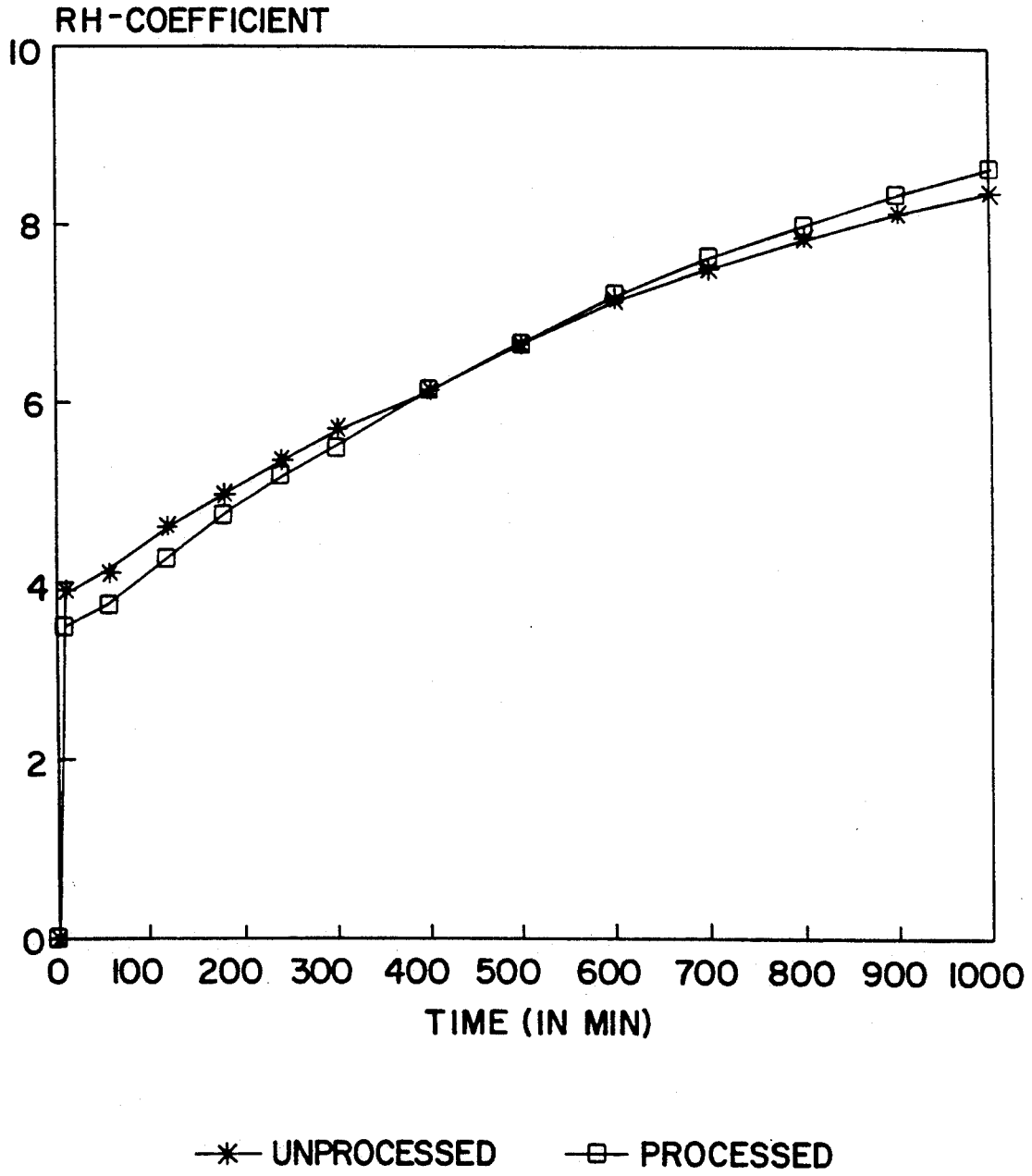

FIG. 2 shows the results obtained with Sample D prior to and after conventional photographic processing including treatment in an alkaline developing bath, in an acidic fixing bath, and rinsing in water. The curve showing asterisks reflects the results obtained with unprocessed Sample D, whereas the curve showing squares reproduces the results obtained with processed Sample D. It is seen that the barrier effect against water in vapour and in liquid form remains substantially unaffected after conventional photographic processing.

EXAMPLE 2

The samples specified hereinafter were conditioned at 30% relative humidity and 22° C. and then treated in conventional photographic processing baths. The dimensional change due to the treatment in these baths was evaluated at a drying temperature of 55° C. in a PAKO 26RA graphic arts processing unit.

Sample E

A conventional photographic PET film support having a thickness of approximately 120 μm and carrying subbing layers as described in example 3 of U.S. Pat. No. 3,649,336, the uppermost subbing layer being coated with a common photosensitive silver halide gelatin layer having a dry weight of 4 g/m2.

Sample F

A conventional photographic PET film support having a thickness of approximately 100 μm and carrying subbing layers on one side as described in U.S. Pat. No. 3,649,336, the uppermost subbing layer being covered in the given order first with a glass layer by bonding an above-mentioned commercially available food-packing film consisting of PET (12 μm thick) carrying a vapour-deposited $SiO_x$ (x=1.7) layer (0.06 μm thick) by means of epoxy adhesive and next on said $SiO_x$ layer with a common photosensitive silver halide gelatin layer coating comprising 6% by weight of the epoxysilane compound No 4 described in column 2 of U.S. Pat. No. 3,661,584, the photosensitive layer coating having a dry weight of 4 g/m2.

Sample G

A conventional photographic PET film support having a thickness of approximately 100 μm and carrying subbing layers on both sides as described in U.S. Pat. No. 3,649,336, the uppermost subbing layer on one side being covered in the given order with a glass layer by bonding an above-mentioned commercially available food-packing film consisting of PET (12 μm thick) carrying a vapour-deposited $SiO_x$ (x=1.7) layer (0.06 μm thick) by means of epoxy adhesive and next on said $SiO_x$ layer with a common photosensitive silver halide gelatin layer coating comprising 6% by weight of the epoxysilane compound No 4 described in column 2 of U.S. Pat. No. 3,661,584, the photosensitive layer coating having a dry weight of 4 g/m2, and the uppermost subbing layer on the other side being covered with a glass layer by bonding an above-mentioned commercially available food-packing film consisting of PET (12 μm thick) carrying a vapour-deposited $SiO_x$ (x=1.7) layer (0.06 μm thick) by means of epoxy adhesive.

In the following Table the values of dimensional change are expressed in μm per meter per processing treatment.

TABLE 1

| Sample | Dimensional change 55° C. 30% RH | 35° C. 60% RH |
|---|---|---|
| E | 54 | 27 |
| F | 37 | 19 |
| G | 32 | 15 |

From the results listed in Table 1 it can be derived that the dimensional stability of Samples F and G comprising glass barrier layers according to the present invention, after having been treated in conventional photographic processing baths, substantially surpasses that of non-barrier-coated Sample E.

We claim:

1. Photographic element having high dimensional stability, said element comprising a hydrophobic polyester film support, a barrier layer retarding diffusion of water in liquid or vapour phase into said hydrophobic polyester film support, and at least one hydrophilic image-precursor layer, wherein said barrier layer is a vapour-deposited glass layer having a thickness of at least 0.01 μm and substantially composed of $SiO_x$, x standing for a value ranging from 1.2 to 1.8.

2. A photographic element according to claim 1, wherein said polyester is polyethylene terephthalate.

3. A photographic element according to claim 1, wherein x stands for a value ranging from 1.5 to 1.7.

4. A photographic element according to claim 1, wherein the thickness of the vapour-deposited layer ranges from 0.05 to 0.15 μm.

5. A photographic element according to claim 1, wherein said hydrophobic polyester film support is provided on both sides with a vapour-deposited glass layer.

6. A photographic element according to claim 1, wherein said hydrophilic layer comprises an organic silicon compound comprising hydrocarbon groups directly or indirectly attached to a silicon atom, at least one of said hydrocarbon groups carrying a group or atom that has chemical affinity for the free reactive groups of said hydrophilic or that can be cross-linked to said free reactive groups through the intermediary of a cross-linking agent.

* * * * *